US010711959B2

(12) United States Patent
Knight et al.

(10) Patent No.: US 10,711,959 B2
(45) Date of Patent: Jul. 14, 2020

(54) MULTI-TIERED FLOATING WATER LANTERN

(71) Applicant: One World Lantern Festival, LLC, Logan, UT (US)

(72) Inventors: David D. Knight, Providence, UT (US); Michael J. Schaefer, Benson, UT (US)

(73) Assignee: One World Lantern Festival, LLC, Logan, UT (US)

( * ) Notice: Subject to any disclaimer, the term of this patent is extended or adjusted under 35 U.S.C. 154(b) by 0 days.

(21) Appl. No.: 16/200,607

(22) Filed: Nov. 26, 2018

(65) Prior Publication Data

US 2020/0116317 A1 Apr. 16, 2020

Related U.S. Application Data

(63) Continuation-in-part of application No. 29/666,198, filed on Oct. 10, 2018.

(51) Int. Cl.

| | |
|---|---|
| ***F21S 6/00*** | (2006.01) |
| ***F21V 15/01*** | (2006.01) |
| ***F21V 17/10*** | (2006.01) |
| ***F21V 1/14*** | (2006.01) |
| ***F21W 111/04*** | (2006.01) |
| ***F21W 121/00*** | (2006.01) |
| ***F21Y 115/10*** | (2016.01) |

(52) U.S. Cl.

CPC ..... *F21S 6/001* (2013.01); *F21V 1/14* (2013.01); *F21V 15/01* (2013.01); *F21V 17/101* (2013.01); *F21W 2111/04* (2013.01); *F21W 2121/00* (2013.01); *F21Y 2115/10* (2016.08)

(58) Field of Classification Search

CPC ..... F21S 6/001; F21V 17/101; F21V 1/14; F21V 15/01; F21Y 2115/10; F21W 2111/04; F21W 2121/00

See application file for complete search history.

(56) References Cited

U.S. PATENT DOCUMENTS

| | | | | | |
|---|---|---|---|---|---|
| 2,320,948 | A | * | 6/1943 | Marthey | B63G 8/41 114/50 |
| 3,307,208 | A | | 3/1967 | Jacobson | |
| 3,614,417 | A | | 10/1971 | Sanford | |
| 4,354,222 | A | * | 10/1982 | Gall | F21V 1/06 362/352 |
| 4,553,194 | A | | 11/1985 | Bailey | |
| 4,896,620 | A | * | 1/1990 | Jones | B63B 51/02 114/253 |
| 5,199,205 | A | | 4/1993 | Klammer | |
| 5,251,113 | A | | 10/1993 | Wagoner et al. | |
| 5,351,432 | A | | 10/1994 | Tse | |

(Continued)

*Primary Examiner* — Tsion Tumebo

(74) *Attorney, Agent, or Firm* — David L. Stott

(57) ABSTRACT

A water lantern for floating on water with an LED candle is provided. The water lantern includes a base, dowel rods and a curtain. The base is designed with a tiered structure extending to a top surface with apertures formed therein to receive the dowel rods and a central recess for receiving the LED candle. The curtain is removably positioned over the base with the dowel rods maintaining the curtain in an expanded open position. The tiered structure of the base enhances the floating stability of the water lantern while also holding the LED candle above the water level to protect the LED candle from splashing water.

20 Claims, 7 Drawing Sheets

(56) References Cited

U.S. PATENT DOCUMENTS

| | | | | |
|---|---|---|---|---|
| 6,000,817 | A * | 12/1999 | Chan | F21V 1/06 362/311.06 |
| 6,502,953 | B2 | 1/2003 | Hajianpour | |
| 7,204,618 | B1 * | 4/2007 | Kuelbs | F21S 9/037 362/35 |
| 7,314,293 | B2 * | 1/2008 | Steier | F21S 6/00 362/351 |
| 7,967,465 | B2 * | 6/2011 | Richmond | F21S 9/03 362/183 |
| 8,337,040 | B1 | 12/2012 | Easley | |
| 8,770,776 | B1 | 7/2014 | Yang | |
| 10,274,188 | B2 * | 4/2019 | Sculler | F21S 6/001 |
| 10,295,130 | B1 * | 5/2019 | Owens | G09F 23/04 |
| 2003/0161138 | A1 | 8/2003 | Parker et al. | |
| 2004/0130899 | A1 * | 7/2004 | Skouras | B44C 5/005 362/351 |
| 2005/0254232 | A1 * | 11/2005 | Bentley | F21S 6/001 362/161 |
| 2006/0092630 | A1 | 5/2006 | Kennedy et al. | |
| 2006/0279956 | A1 * | 12/2006 | Richmond | F21S 9/037 362/374 |
| 2010/0039800 | A1 * | 2/2010 | Imperial | F21S 13/12 362/154 |
| 2012/0320606 | A1 * | 12/2012 | Vossoughi | F21V 1/00 362/351 |
| 2015/0077980 | A1 * | 3/2015 | Coughlin | F21V 21/14 362/183 |
| 2015/0353170 | A1 * | 12/2015 | Greenfield | B63B 22/18 441/11 |

* cited by examiner

MULTI-TIERED FLOATING WATER LANTERN

CROSS-REFERENCE TO RELATED APPLICATION

The present application is a continuation-in-part of U.S. Design patent application No. 29/666,198, filed on Oct. 10, 2018, entitled Multi-Tier Floating Water Lantern, the disclosure of which is incorporated by reference herein in its entirety.

TECHNICAL FIELD

The present invention relates generally to lanterns and, more specifically, the present invention relates to floating water lanterns.

BACKGROUND

Gatherings with family and friends and even with people you don't know in a festival type event have always been popular. One activity in the festival setting, among hundreds and even thousands of people, is to release water lanterns into a body of water at the festival location. Releasing hundreds and even thousands of water lanterns in the water as the sun sets in the sky and the light begins to dim has been found to be highly memorable. Among other things, this memorable activity has been found to be a time for bonding, contemplation and to renew commitments in life among family, significant partners and friends while watching your lit lantern with many other lanterns on the water. As this activity of floating hundreds or even thousands of lanterns at a single location has gained in popularity, those that are sponsoring these events have found the clean-up of the lanterns from the water to be difficult. This task becomes especially difficult if the water lanterns tip over and capsize. Further, sometimes the shore line for these events is not conducive for a person to set the lantern in the water and, as such, a sloped ramp may be used to slide the lanterns down to the water's edge. However, sliding the lanterns down a sloped ramp also often results in the lantern toppling over as it enters the water. Further, windy climate conditions can also play a factor in the water lanterns capsizing in the water. For those sponsoring these floating lantern events, it is also important to minimize the weight of the lantern to make shipping of the lanterns more cost effective while also having a lantern that can maintain its purpose of floating through the above-noted releasing and collection process even in windy climate conditions.

BRIEF SUMMARY OF THE INVENTION

The present invention is directed to various embodiments of a water lantern and method thereof. In one embodiment, the water lantern includes a lower base, an upper base, dowel rods, and a curtain. The lower base includes a bottom surface and an upper surface with a lower base periphery extending between the bottom surface and the upper surface of the lower base. The upper base is positioned above the lower base, the upper base including a top surface extending to an upper base periphery. The top surface of the upper base includes apertures defined therein. The dowel rods each extend between a first end and a second end, one of the first and second ends of each of the dowel rods configured to be removably inserted and positioned within a corresponding one of the apertures defined in the upper base. The curtain is moveable between a non-use state and an expanded use state, the expanded use state of the curtain, upon the dowel rods being positioned in the apertures, being sized and configured to be removably positioned around each of the positioned dowel rods. With this arrangement, the upper base periphery extends to define an upper base perimeter and the lower base periphery extends to define a lower base perimeter, the upper base perimeter being smaller than the lower base perimeter.

In another embodiment, the top surface of the upper base includes a central recess defined therein. In a further embodiment, the water lantern includes an LED candle member sized and configured to be positioned in the central recess of the upper base.

In another embodiment, the upper base is generally symmetrically positioned over the upper surface of the lower base. In another embodiment, the upper base is adhesively coupled to the lower base. In another embodiment, the upper base is integrally formed with the lower base. In still another embodiment, the upper base periphery of the upper base is at least partially off-set relative to the lower base periphery of the lower base. In yet another embodiment, the upper base is positioned relative to the lower base so as to exhibit a multi-tiered structure.

In another embodiment, the curtain extends to define an outer surface such that, in the non-use state, the outer surface of the curtain is configured to receive writing indicia thereon so that, upon positioning the curtain in the expanded use state, the writing indicia is viewable along the outer surface. In another embodiment, the curtain includes a paper material.

In accordance with another embodiment of the present invention, a water lantern for floating on water with an LED candle positioned therewith is provided. The water lantern includes a base, multiple dowel rods, and a curtain. The base includes a tiered structure, the tiered structure extending with a lower upward facing surface and a top upward facing surface to define the tiered structure with a step therebetween. The step extends between the lower upward facing surface and the top upward facing surface of the base, the top upward facing surface defining multiple apertures therein. The multiple dowel rods each extend between a first end and a second end, one of the first and second ends of each of the dowel rods sized and configured to be removably inserted and positioned within a corresponding one of the multiple apertures defined in the top upward facing surface. The curtain is moveable between a non-use state and an expanded use state. With this arrangement, upon the multiple dowel rods being positioned in the corresponding ones of the multiple apertures, the curtain is sized and configured to be removably positioned over the base such that the positioned multiple dowel rods maintain the curtain in the expanded use state.

In another embodiment, the top upward facing surface of the base includes a central recess defined therein, the central recess sized and configured to receive the LED candle. In another embodiment, the base extends to define a lower periphery and an upper periphery, the lower periphery extending upward to the lower upward facing surface and the upper periphery extending upward to the top upward facing surface. In still another embodiment, the tiered structure of the base exhibits a generally symmetrical structure. In yet another embodiment, the base includes at least one of a wood material and a polymeric material. In another embodiment, the curtain includes an outer surface such that, in the non-use state, the outer surface of the curtain is configured to receive writing indicia thereon so that, upon positioning the curtain in the expanded use state, the writing indicia is viewable along the outer surface.

In accordance with another embodiment of the present invention, a method for controlling a large number of floating devices in a body of water is provided. The method includes the steps of: providing multiple water lanterns for floating on water, each of the water lanterns including a base exhibiting a tiered structure with a lower base portion and an upper base portion, the upper base portion being smaller than the lower base portion, the upper base portion including dowel rods extending upward therefrom and including a curtain so as to be expanded around the dowel rods; positioning a buoy system in the body of water, the buoy system including a floating line extending across the body of water to form a containment region within the body of water; facilitating a region along or adjacent a shore of the body of water for releasing the water lanterns in the body of water; and retrieving the multiple water lanterns from the body of water by pulling on the line to minimize the containment region and to move the water lanterns adjacent a portion of the shore of the body of water for collection and disposal.

In another embodiment, the facilitating step includes releasing the water lanterns down a portable ramp so that the water lanterns enter the body of the water within the containment region defined by the buoy system. In another embodiment, the facilitating step includes releasing the water lanterns by manually setting the water lanterns directly on the body of water. In another embodiment, the providing step includes providing the tiered structure having a symmetrical tiered structure. In another embodiment, the providing step includes providing the tiered structure with curved portions defined in the tiered structure. In another embodiment, the retrieving step includes drawing the line into the shore to minimize the containment region against the shore to move the water lanterns adjacent the shore.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
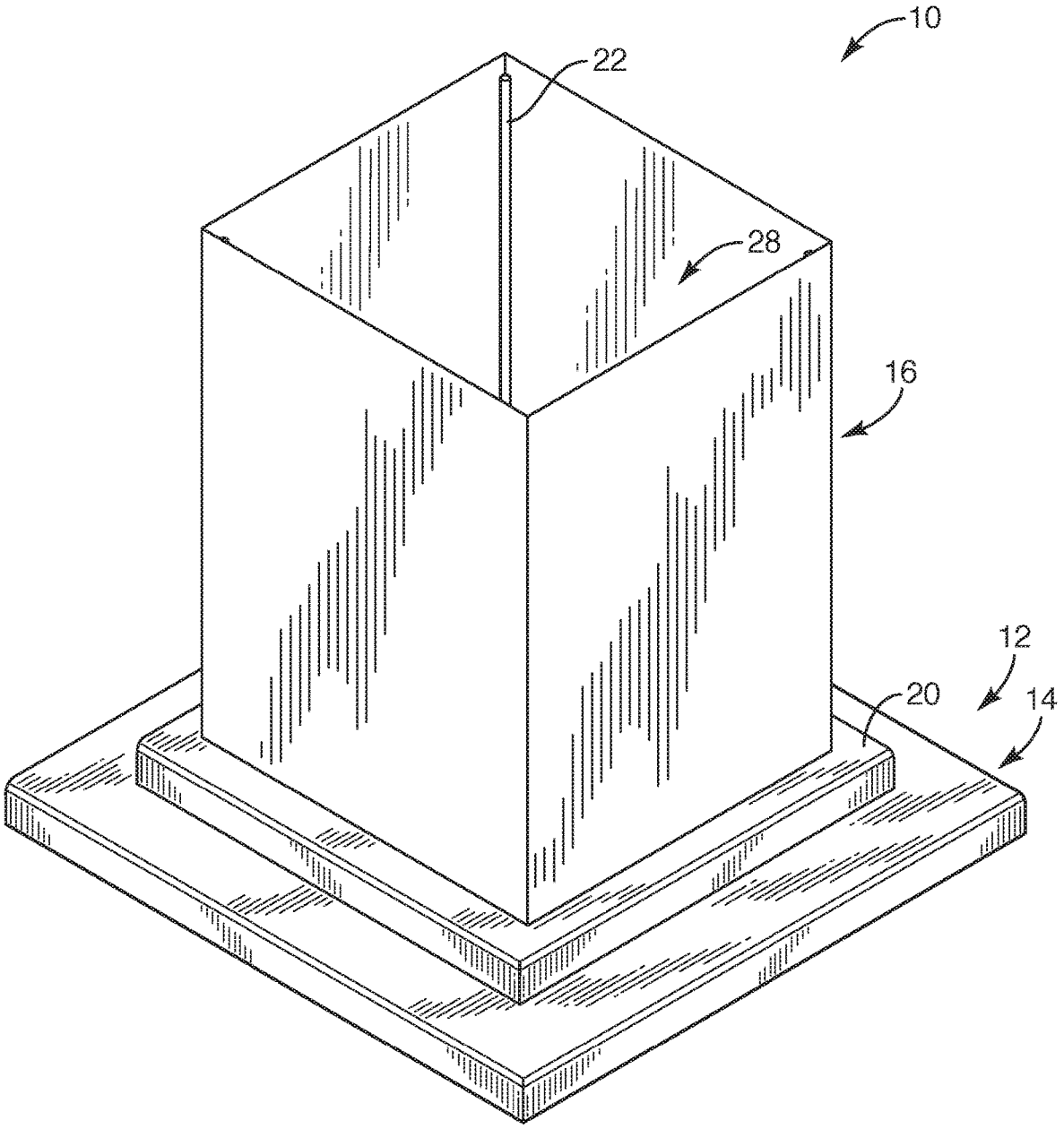
FIG. 1 is a perspective view of a water lantern, according to an embodiment of the present invention.
Figure 3:
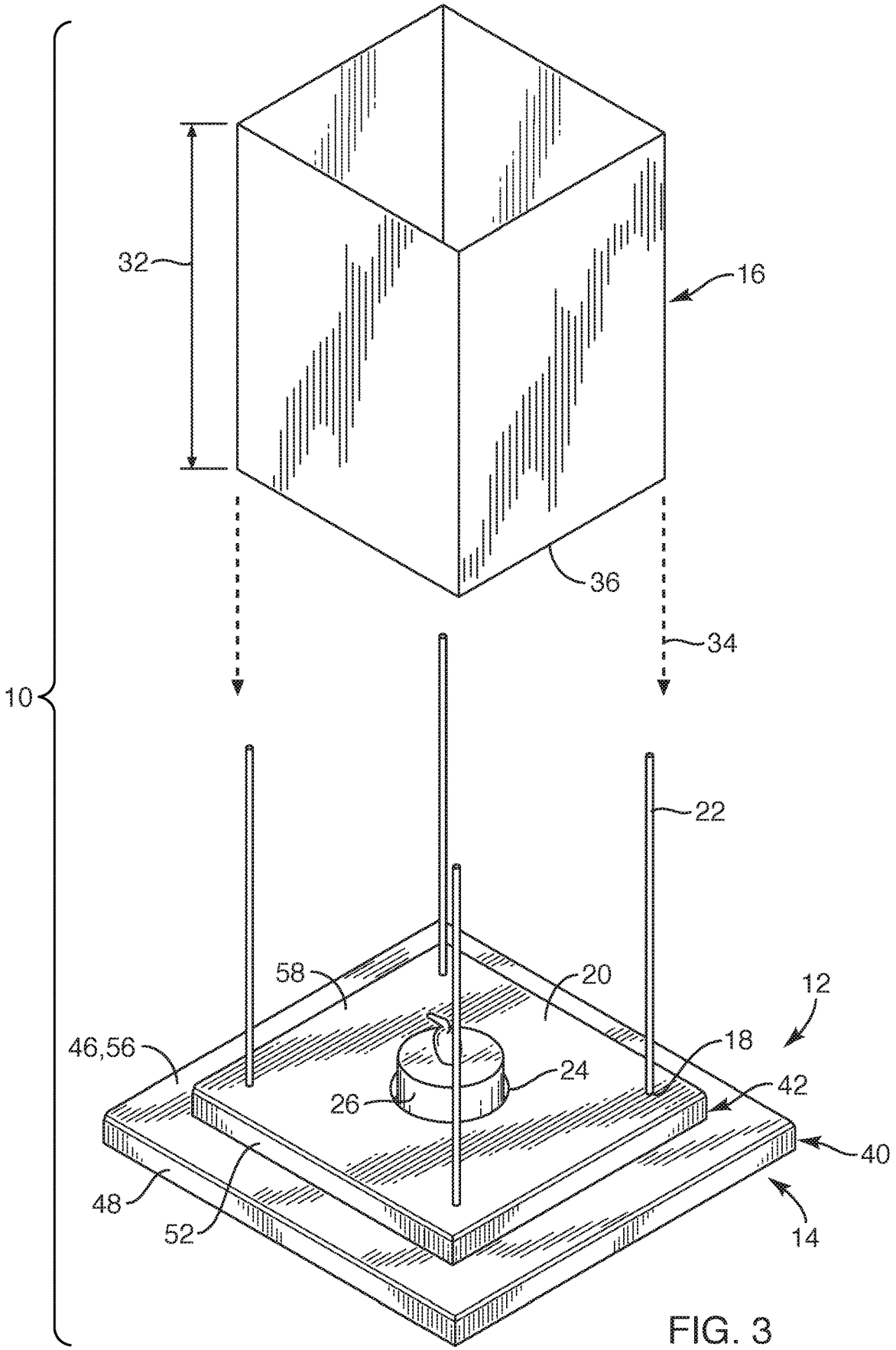
FIG. 3 is an exploded view of a partially assembled water lantern, depicting dowel rods positioned in a base of the water lantern with a curtain disposed above the water lantern, according to another embodiment of the present invention.

Referring to FIGS. 1 and 3, a water lantern 10 for floating in a body of water, is provided. The water lantern 10 may be designed for single use and, as such, the water lantern may be disposable. Some of the components and materials of the water lantern 10 may also be employed on multiple occasions and then disposed of, depending upon the care placed upon the various components of the water lantern 10. The water lantern 10 is designed with a base 12 that may be sized and configured for stability and versatility in various types of water and climate conditions. For example, the base 12 of the water lantern 10 is designed to substantially minimize capsizing or tipping through the process of releasing and collecting the water lantern 10 in varied climate conditions to and from a body of water, such as lakes, ponds, bays, and open water. Depending upon the venue, such as a festival or large event, that the water lantern 10 may be employed in, the stability of the base 12 readily facilitates (and uncomplicates) the process of collecting potentially hundreds and even thousands of water lanterns 10 from a body of water. Further, with such stability of the base 12, the water lantern 10 may be made of materials and exhibit structure that is relatively light weight to minimize manufacturing and shipping costs of the water lantern 10.

In one embodiment, the water lantern 10 may include the base 12 with a tiered structure 14 and a curtain 16. The base 12 may include apertures 18 defined in a top surface 20 of the base 12, the apertures 18 sized to receive dowel rods 22. The top surface 20 may also define a central recess 24 therein sized for holding an LED candle 26. Upon the dowel rods 22 being manually inserted in the apertures 18, the curtain 16 may be removably positioned around the dowel rods 22 so as to surround the dowel rods 22 and a space 28 above the top surface 20 of the base 12. With this arrangement, the tiered structure 14 of the water lantern 10 may be sized and configured to float in the body of water such that the dimensions of the tiered structure 14 limit potential capsizing of the water lantern 10 in various climate conditions and through the process of releasing the water lantern 10 into and collecting the water lantern 10 or multiple water lanterns 10 (as the case may be) from the water. Further, with the LED candle activated, it is a memorable experience to watch the water lantern 10 floating on the water and even more amazing and memorable to view large numbers of lit water lanterns 10 floating on the water with family and friends in, for example, a festival or event type setting.

Figure 2:
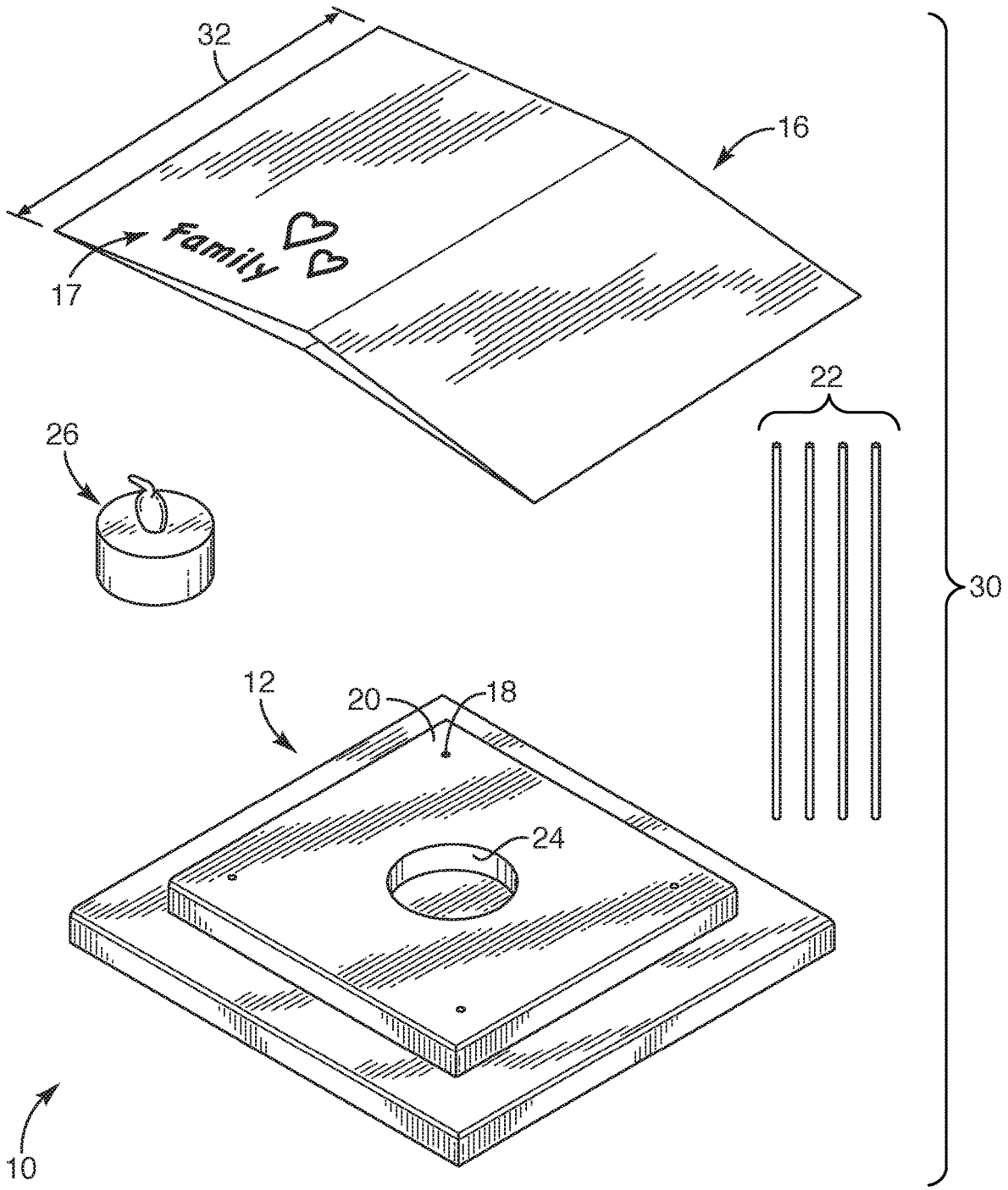
FIG. 2 is a non-assembled water lantern, depicting the water lantern provided as a kit, according to another embodiment of the present invention.

Now with reference to FIG. 2, the water lantern 10 may be packaged, in disassembled form, as a kit 30. The packaging (not shown) of the kit 30 may be in the form of a sealed plastic wrapper, a paper sack, thin box or the like. The kit 30 may include all or most of the components of the water lantern 10 in the kit 30. For example, in one embodiment, the kit 30 may include the base 12, four dowel rods 22, and the curtain 16. In another embodiment, the kit 30 may additionally include the LED candle 26 or the like. In another embodiment, the kit 30 may additionally include the LED candle 26 and/or a tea candle that may be lit with a match or the like. In another embodiment, the kit 30 may include the base 12 as a single structure formed from a two piece stacked structure, adhesively attached together, so that the two piece stacked structure may be integrally attached and formed as the base 12 of the water lantern 10. In another embodiment, the kit 30 may include the base 12 as multiple piece structures for the user to adhesively attach together, or attach by some other means, in a stacked manner. In still another embodiment, the kit 30 may include the base 12 as a single structure that exhibits the tiered structure 14, the single structure being a monolithic seamless structure.

With reference to FIGS. 2 and 3, upon opening the kit 30, a user may readily recognize how to assemble the components of the kit 30. For example, in the kit 30, the apertures 18 defined in the top surface 20 of the base 12 may be pre-drilled holes adjacent a periphery or corner portions of the base 12. Further, the central recess 24 may be a pre-drilled hole sized and configured to receive the LED candle 26. The pre-drilled holes defining the apertures 18 may each be drilled a common distance into the top surface 20 of the base 12. The dowel rods 22 may be sized and configured to be positioned in the apertures 18 and held with, for example, an interference type fit (as shown in FIG. 3). In this manner, one step for assembling the water lantern 10 may be to insert the dowel rods 22 into the apertures 18. Another step may be to position the curtain 16 above the base 12 so that the curtain 16 surrounds the inserted dowel rods 22. In the kit 30, the curtain 16 may be packaged in a substantially flat non-use state, as depicted in FIG. 2. The curtain 16 may be formed of a paper material, formed into a continuous loop. The paper material of the curtain 16 may extend with a height 32 and a length (the length extending the dimension of a perimeter or periphery of the continuous loop of the curtain 16) such that end portions, along the height 32, may be adhesively coupled to form the continuous loop. Such continuous loop of the curtain 16 may be manually moved between the non-use state (FIG. 2) and an opened, expanded state (FIG. 3), the opened expanded state of the curtain 16 may be a use state of the water lantern 10. In one embodiment, in the flat non-use state of the curtain 16, the curtain 16 may be written upon with writing indicia 17 (or drawing indicia) to provide, for example, any writing indicia 17, such as a personal statement and/or drawing, that the user may desire to be written upon the curtain 16. Once the writing indicia 17 has been written/drawn on the curtain 16 as desired, the curtain 16 may then be manually moved to the expanded use state. With the curtain 16 in the expanded use state, the curtain 16 may then be assembled to the base 12 by positioning the curtain 16 above the dowel rods 22 and moved downward over the dowel rods 22, as depicted by arrow 34 in FIG. 3, until a bottom edge 36 of the curtain 16 sits on the top surface 20 of the base 12, as depicted in FIG. 1. The LED candle 26 may be positioned in the central recess 24 before or after positioning the curtain 16 to surround the dowel rods 22 above the base 21. Such LED candle 26 may be activated at any time prior to releasing the water lantern 10 into the body of water.

Figure 4:
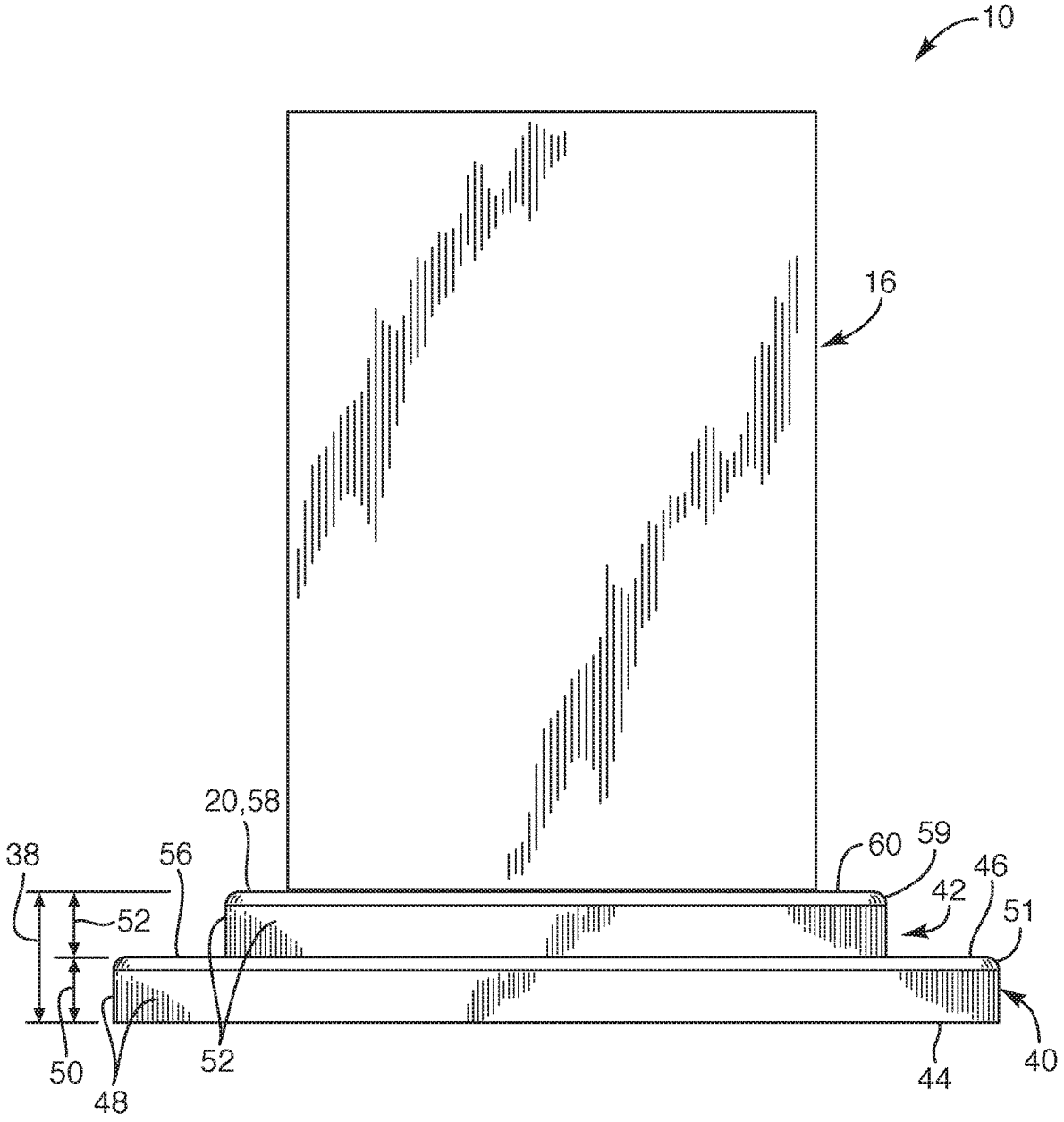
FIG. 4 is a front view of the water lantern, according to another embodiment of the present invention.
Figure 5:
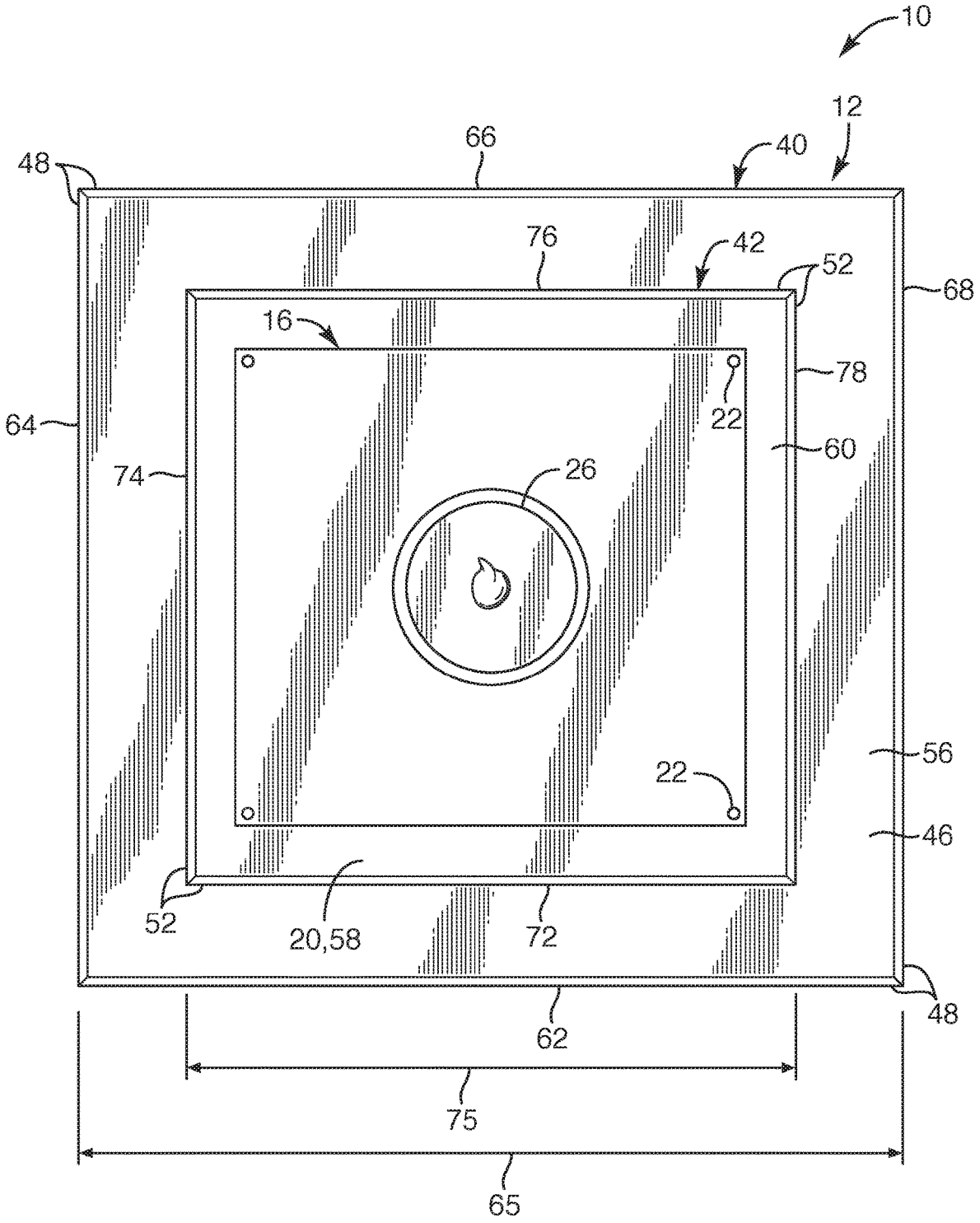
FIG. 5 is a top view of the water lantern, according to another embodiment of the present invention.

Now with reference to FIGS. 3, 4 and 5, as previously set forth, the base 12 of the water lantern 10 may include the tiered structure 14 with the curtain 16 positioned thereon via the dowel rods 22. To form the tiered structure 14 of the base 12, the base 12 may be formed, for example, from two pieces of stacked wood material. The two pieces of wood material may be adhesively attached to form the tiered structure 14 such that the two pieces of wood material may extend with differently sized or shaped peripheries. The tiered structure 14 of the base 12 may define a base height 38. Further, the tiered structure 14 of the base 12 may extend to define a lower base 40 and an upper base 42. The lower base 40 may extend to define a bottom surface 44 and an upper surface 46 with a lower base periphery 48 extending between the bottom surface 44 and the upper surface 46. The lower base 40 extends with a first height 50 which also spans and defines the height of the lower base periphery 48. In one embodiment, the bottom surface 44 and the upper surface 46 of the lower base 40 may extend to define a generally square shape or any other suitable shape, such as pentagonal, hexagonal or any other suitable generally symmetrical shape, such as a circular shape. The lower base periphery 48 may extend with a length or lower perimeter such that the lower perimeter defines the length along the longitudinal dimension of each side (in total) of the lower base periphery 48. In other words, the lower perimeter of the lower base periphery 48 defines a continuous line forming the boundary of the lower base 40, which equates to the length of the continuous line or the lower perimeter. In this manner, whatever geometric shape of the bottom or upper surfaces 44, 46 of the lower base 40, i.e., square, circular or any other suitable geometric shape, the lower base periphery 48 includes a lower perimeter that defines a length of the boundary of such geometric figure, such as the lower base 40.

In one embodiment, the lower base periphery 48 may, at least partially, extend generally perpendicular relative to the bottom and upper surfaces 44, 46 of the lower base 40. In another embodiment, the lower base periphery 48 may extend along the first height 50 with a curvature 51 or arcuate structure. In still another embodiment, the lower base periphery 48 may extend at an angle from the edge of the bottom surface 44 to the upper surface 46 such that the bottom surface 44 may be larger than the upper surface 46 of the lower base 40.

The upper base 42 may also extend with a lower surface (not shown) and a top surface 58 of the upper base 42 (which also may be the top surface 20 of the base 12). The lower surface and the top surface 58 of the upper base 42 may define an upper base periphery 52 extending between the lower surface and the top surface 58. The upper base 42 may extend with a second height 54, the second height 54 also being the height of the upper base periphery 52. Similar to the lower base 40, the lower surface and top surface 58 of the upper base 42 may extend to define a generally square shape or other suitable shape that may be similar to the lower base 40. In another embodiment, the top surface 58 of the upper base 42 may extend to define a different shape the upper surface 46 of the lower base 40, such as a circular shape or square shape or any other shape that exhibits a tiered or stepped structure of the base 12. Further, similar to the lower base 40, the upper base periphery 52 may, at least partially, extend generally perpendicular relative to the lower surface and top surface 58 of the upper base 42. In another embodiment, the upper base 42 may extend with a curvature 59 or arcuate structure or an angle between the lower surface and the top surface 58 of the upper base 42, similar to the periphery of the lower base 40. Further, similar to the lower base periphery 48, the upper base periphery 52 may extend with a length or upper perimeter (as a continuous boundary line) such that the upper perimeter defines the length along the longitudinal dimension (or radial dimension in an alternate embodiment of the top surface of the upper base 42 being a circular shape, for example) of each side of the upper base periphery 52.

In one embodiment, the upper base periphery 52 or upper perimeter length of the upper base 42 may be shorter than the lower base periphery 48 or lower perimeter length of the lower base 40. Since the upper base periphery 52 is shorter than the lower base periphery 48, the upper base periphery 52 of the upper base 42 is not flush with the lower base periphery 48 of the lower base 40, but instead, the base 12 defines a first ledge 56 between the lower base periphery 48 and the upper base periphery 52. This first ledge 56 may also be a common surface of the upper surface 46 of the lower base 40. The first ledge 56 may, at least partially, define the tiered structure 14 of the base 12.

In another embodiment, the tiered structure 14 of the base 12 may extend such that the lower base 40 may be larger than the upper base 42. In one embodiment, the top and bottom surfaces 20, 44 of the base 12 may exhibit a generally square shape such the lower base 40 may be larger than the upper base 42 to define the tiered structure 14 exhibiting the first ledge 56 and a second ledge 60. The second ledge 60 may also be the top surface 20 of the base 12 of the water lantern 10. Further, in another embodiment, the tiered structure 14 may define a step extending generally perpendicular relative to and between the first ledge 56 and the second ledge 60, the step being the structure of the upper base periphery 52 of the upper base 42. In this manner, the tiered structure 14 of the base 12 may exhibit a stepped structure or an off-set stacked structure.

In another embodiment, the lower base 40 may include a first lower side 62, a second lower side 64, a third lower side 66 and a fourth lower side 68, the first lower side 62 being opposite of the third lower side 66 and the second lower side 64 being opposite of the fourth lower side 68. Further, the first lower side 62, the second lower side 64, the third lower side 66 and the fourth lower side 68 of the lower base 40 may extend to define the lower base periphery 48 and each extend between the bottom surface 44 and the upper surface 46 of the lower base 40. Similarly, the upper base 42 may extend to define a first upper side 72, a second upper side 74, a third upper side 76, and a fourth upper side 78 such that the first upper side 72 may extend opposite the third upper side 76 and the second upper side 74 may extend opposite the fourth upper side 78, of which each upper side may extend to define the upper base periphery 52. In one embodiment, the upper base 42 may be positioned relative to the lower base 40 such that the first upper side 72 and the third upper side 76 may extend longitudinally parallel and off-set relative to the first lower side 62 and the third lower side 66, respectively, so as to exhibit an off-set stacked structure. Similarly, in another embodiment, each of the first, second, third and fourth upper sides 72, 74, 76, 78 may each extend longitudinally parallel and off-set relative to the first, second, third and fourth lower sides 62, 64, 66, 68, respectively, so as to exhibit an off-set stacked structure.

Further, in one embodiment, the first, second, third, and fourth upper sides 72, 74, 76, 78 of the upper base 42 may each define a upper side length 75. In one embodiment, the upper side length 75 of each of the first, second, third, and fourth upper sides 72, 74, 76, 78 of the upper base 42 may extend a similar length. In another embodiment, the first, second, third and fourth lower sides 62, 64, 66, 68 of the lower base 40 may each define a lower side length 65, the lower side length each having a substantially common length. In one embodiment, the upper side length 75 of each side of the upper base 42 may be smaller than the lower side length 65 of each of the lower sides of the lower base 40. In this manner, the upper base 42 and the lower base 40 may exhibit the tiered structure 14 of the base 12 with the first ledge 56 extending along the upper surface 46 of the lower base 40 and the second ledge 60 extending along the top surface 20 of the upper base 42. In another embodiment, oppositely positioned first and third upper sides 72, 76 may define the upper side length 75 that may be smaller than each of the lower sides defining the lower side length 65 of the lower base 40.

In one embodiment, the lower side length 65 of the lower base 40 may be about 7.5 inches or within the range of about 6-10 inches and the upper side length 75 of the upper base 42 may be about 5.75 inches or within the range of about 4.5-8 inches. In another embodiment, the first height 50 of the lower base 40 may be about 7/16 inches or within the range between about ¼ inch and about 1 inch or greater. Similarly, the second height 54 of the upper base 42 may also be about 7/16 inches or within the range between about ¼ inch and about 1 inch or greater. The above-noted dimensions and ranges are not meant to be limiting, but rather, only meant to set forth an example of the tiered structure 14 of the base 12.

Figure 6:
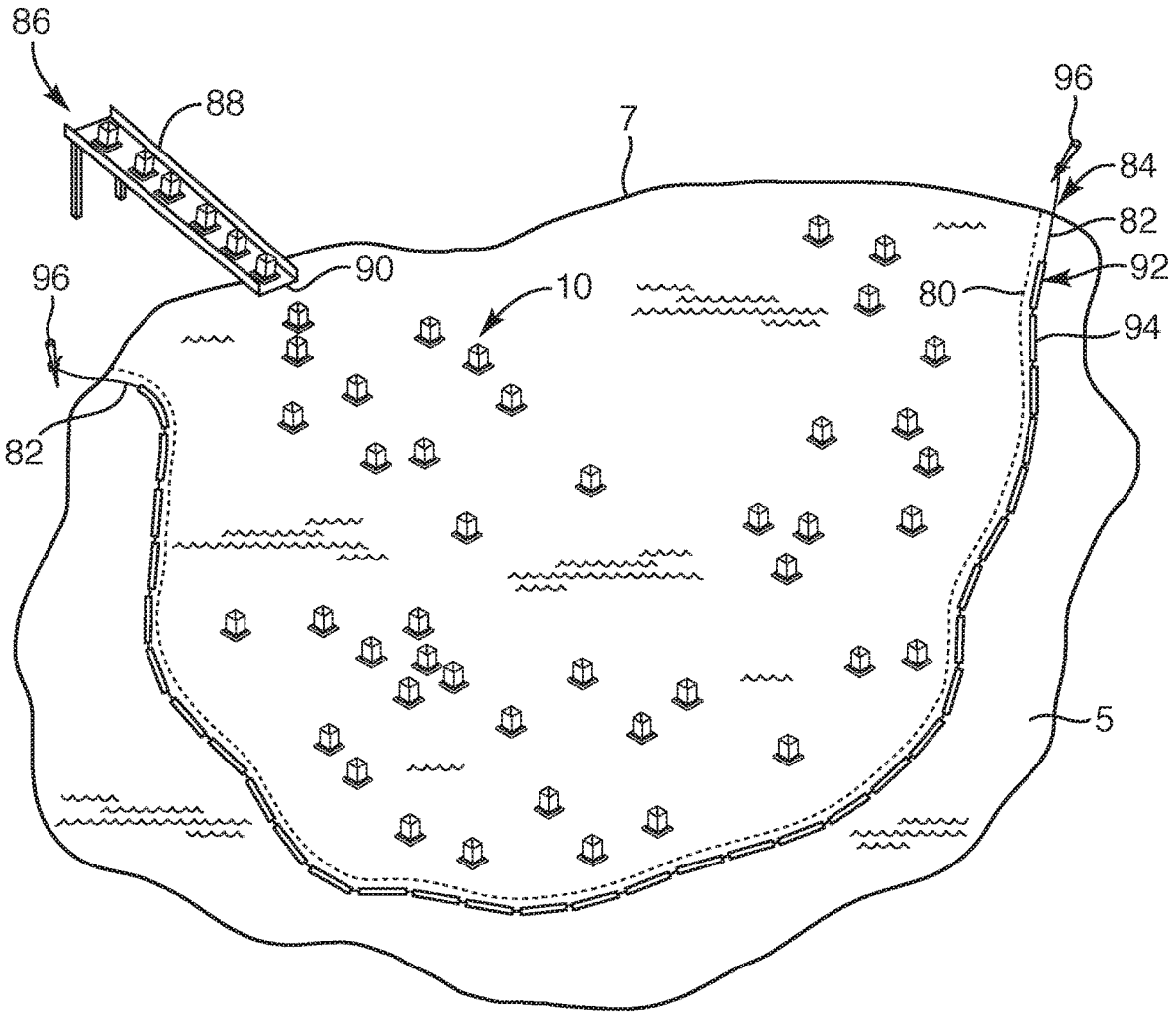
FIG. 6 is a perspective view of multiple water lanterns floating on a body of water, depicting a ramp system and a buoy system for providing a region for the water lanterns to be maintained in the body of water, according to another embodiment of the present invention.
Figure 7:
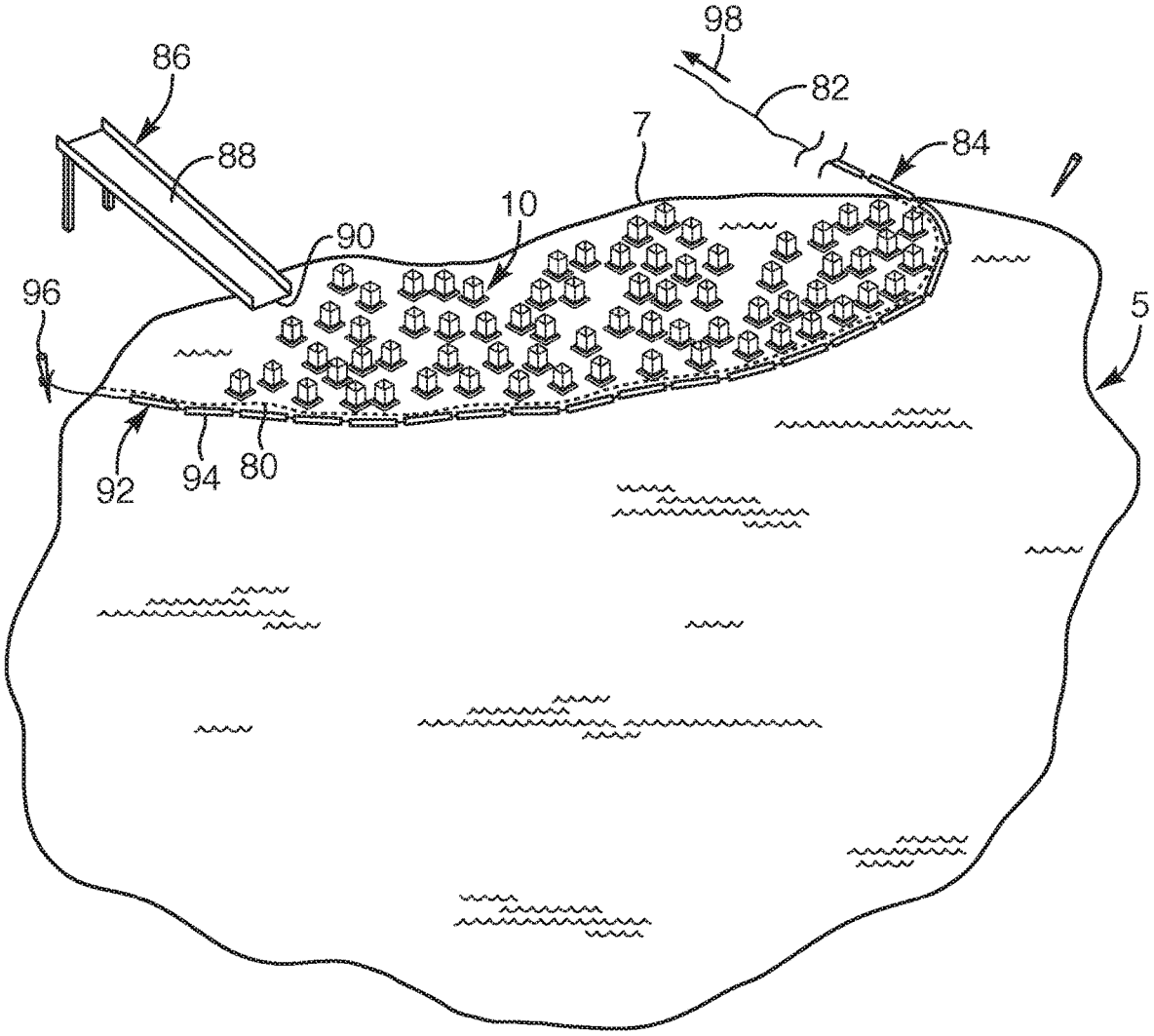
FIG. 7 is a perspective view of multiple water lanterns floating in the body of water, depicting a method of retrieving the water lanterns from the body of water, according to another embodiment of the present invention.

Now with reference to FIGS. 6 and 7, in one embodiment, a method of deploying large numbers of water lanterns 10 to float within a body of water 5 will now be described. For example, FIG. 6 depicts multiple water lanterns 10 being released within a containment region 80 of the body of water 5. The containment region 80 may be defined by a line 82 of a buoy system 84. Such buoy system 84 may be positioned to define the containment region 80 prior to releasing the multiple lanterns 10. To release the water lanterns 10, in one embodiment, the water lanterns 10 may be individually placed in the water along readily accessible access points along a shore 7 of the body of water 5, for example. In another embodiment, on occasions where there are not readily accessible access points along the shore 7, it may be advantageous to employ a ramp system 86, as depicted. The ramp system 86 may include a ramp 88 extending with a slope so that an end 90 of the ramp 88 extends into a portion of the body of water 5. In this manner, the base 12 of the water lanterns 10 may be sized and configured to be sent down the sloped ramp so that the water lanterns 10 do not capsize upon entering the body of water 5. Upon multiple lanterns being released in the body of water, as depicted in FIG. 6, and the event of enjoying the floating water lanterns is completed, it is necessary to collect the water lanterns 10 from the body of water 5 in an efficient manner. For example, as depicted in FIG. 7, the water lanterns 10 may be gathered and collected from the body of water 5 with the assistance of the buoy system 84. The buoy system 84 may include the line 82 and multiple flotation devices 92. The flotation devices 92 may be in the form of a tubular structure 94 through which the line 82 may extend. The line 82 may also include stakes 96 at end portions of the line 82. One end or both ends (or end portions) of the line 82 may be pulled, as shown by arrow 98, to minimize the containment region 80 defined by the line 82 of the buoy system 84 so that the water lanterns 10 may be drawn and pulled adjacent the shore 7 of the body of water 5. Due to the tiered structure 14 of the base 12, the water lanterns 10, as a whole, may substantially remain floating, despite being pulled across the body of water 5 to a collection point or portion along the shore 7. Once the water lanterns 10 are sufficiently brought adjacent the shore 7 with the containment region 80 being minimized, the water lanterns 10 may then be manually removed from the containment region 80 defined in the body of water 5. The water lanterns 10 may then be saved for another use or discarded, as desired.

With reference to FIG. 2, in one embodiment, the base 12 and the dowel rods 22 of the water lantern 10 may be formed of a wood material, such as paulownia wood or any other suitable wood material. In another embodiment, the base 12 and/or the dowel rods 22 may be formed of a polymeric material. In another embodiment, the base 12 may be formed of a polymeric material such that the base 12 may extend with sidewalls defining hollow portion therein. As previously set forth herein, the curtain 16 may be formed from a paper material or the like, such as cloth. Each of the components of the water lantern 10 may be formed employing processes and manufacturing techniques known by one of ordinary skill in the art. The LED candle 26 may be any known suitable LED candle light fixture or the like sized and configured to be employed with water lanterns, as known to one of ordinary skill in the art.

While the invention may be susceptible to various modifications and alternative forms, specific embodiments have been shown by way of example in the drawings and have been described in detail herein. Further, the structural features of any one embodiment disclosed herein may be combined or replaced by any one of the structural features of another embodiment set forth herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A floatable water lantern, comprising:

a lower base having a bottom surface and an upper surface with a lower base periphery extending between the bottom surface and the upper surface of the lower base;

an upper base positioned above the lower base, the upper base having a top surface extending to an upper base periphery, the top surface of the upper base including apertures defined therein;

dowel rods each extending between a first end and a second end, one of the first and second ends of each of the dowel rods configured to be removably inserted and positioned within a corresponding one of the apertures defined in the upper base; and a curtain moveable between a non-use state and an expanded use state such that, upon the dowel rods being positioned in the apertures, the curtain in the expanded use state is sized and configured to be removably positioned around each of the positioned dowel rods, the curtain, in the expanded use state, extends continuously between a lower end and an upper end such that the lower end is positioned adjacent the top surface of the upper base and the upper end of the curtain extends continuously in an open-ended arrangement such that the dowel rods maintain the curtain in the expanded use state;

wherein the upper base periphery extends to define an upper base perimeter and the lower base periphery extends to define a lower base perimeter, the upper base perimeter being smaller than the lower base perimeter.

2. The floatable water lantern of claim 1, wherein the top surface of the upper base including a central recess defined therein.

3. The floatable water lantern of claim 2, further comprising an LED candle member sized and configured to be positioned in the central recess of the upper base.

4. The floatable water lantern of claim 1, wherein the upper base is generally symmetrically positioned over the upper surface of the lower base.

5. The floatable water lantern of claim 1, wherein the upper base is adhesively coupled to the lower base.

6. The floatable water lantern of claim 1, wherein the upper base is integrally formed with the lower base.

7. The floatable water lantern of claim 1, wherein the upper base periphery of the upper base is at least partially off-set relative to the lower base periphery of the lower base.

8. The floatable water lantern of claim 1, wherein the upper base is positioned relative to the lower base so as to exhibit a multi-tiered structure.

9. The floatable water lantern of claim 1, wherein the curtain comprises an outer surface such that, in the non-use state, the outer surface of the curtain is configured to receive writing indicia thereon so that, upon positioning the curtain in the expanded use state, the writing indicia is viewable along the outer surface.

10. The floatable water lantern of claim 1, wherein the curtain comprises a paper material.

11. A water lantern for floating on water with an LED candle positioned therewith, the water lantern comprising:

a base having a tiered structure, the tiered structure of the base extending with a lower upward facing surface and a top upward facing surface to define the tiered structure with a step therebetween, the step extending between the lower upward facing surface and the top upward facing surface of the base, the top upward facing surface defining multiple apertures therein;

multiple dowel rods each extending between a first end and a second end, one of the first and second ends of each of the dowel rods sized and configured to be removably inserted and positioned within a corresponding one of the multiple apertures defined in the top upward facing surface; and a curtain moveable between a non-use state and an expanded use state, the curtain, in the expanded use state, extends continuously between a lower end and an upper end such that, upon the multiple dowel rods being positioned in the base, the lower end of the curtain is configured to be positioned adjacent the top upward facing surface of the base so as to surround each of the multiple dowel rods positioned in the base and the upper end of the curtain is configured to extend continuously in an open-ended arrangement such that the positioned multiple dowel rods engage the curtain and maintain the curtain in the expanded use state.

12. The water lantern of claim 11, wherein the top upward facing surface of the base including a central recess defined therein, the central recess sized and configured to receive the LED candle.

13. The water lantern of claim 11, wherein the base extends to define a lower periphery and an upper periphery, the lower periphery extending upward to the lower upward facing surface and the upper periphery extending upward to the top upward facing surface.

14. The water lantern of claim 11, wherein the tiered structure of the base exhibits a generally symmetrical structure.

15. The water lantern of claim 11, wherein the base comprises at least one of a wood material and a polymeric material.

16. The water lantern of claim 11, wherein the curtain comprises an outer surface such that, in the non-use state, the outer surface of the curtain is configured to receive writing indicia thereon so that, upon positioning the curtain in the expanded use state, the writing indicia is viewable along the outer surface.

17. A method for containing numerous floating devices in a body of water, comprising:

providing multiple water lanterns for floating on water, each of the water lanterns including a base exhibiting a tiered structure with a lower base portion and an upper base portion, the upper base portion being smaller than the lower base portion, the upper base portion including dowel rods extending upward therefrom and including a curtain, the curtain moveable to an expanded state so as to engage and surround each of the dowel rods such that the curtain extends continuously between a lower end and an upper end, the lower end positioned adjacent the upper base portion and the upper end extending continuously in an open-ended arrangement so as to be maintained in the expanded state by each of the dowel rods;

positioning a buoy system along a surface of the body of water, the buoy system including a floating line extending along the surface of the body of water to form a containment region along the surface of the body of water;

facilitating a region along or adjacent a shore of the body of water for releasing the water lanterns along the surface of the body of water; and retrieving the multiple water lanterns from the surface of the body of water by pulling on the line to minimize the containment region along the surface of the body of water and to move the water lanterns adjacent a portion of the shore of the body of water for collection and disposal.

18. The method according to claim 17, wherein the facilitating comprises releasing the water lanterns down a portable ramp so that the water lanterns enter the body of the water within the containment region defined by the buoy system.

19. The method according to claim 17, wherein the facilitating comprises releasing the water lanterns by manually setting the water lanterns directly on the body of water.

20. The method according to claim 17, wherein the providing comprises providing the tiered structure with curved portions defined in the tiered structure.

* * * * *